US007958714B2

(12) United States Patent
Date et al.

(10) Patent No.: US 7,958,714 B2
(45) Date of Patent: Jun. 14, 2011

(54) FALSE TWISTING YARN AND PRODUCTION METHOD THEREOF

(75) Inventors: Hiroaki Date, Inazawa (JP); Noboru Ueno, Tokyo (JP)

(73) Assignee: Toray Industries, Inc. (JP)

( * ) Notice: Subject to any disclaimer, the term of this patent is extended or adjusted under 35 U.S.C. 154(b) by 255 days.

(21) Appl. No.: 12/373,073

(22) PCT Filed: Jul. 11, 2007

(86) PCT No.: PCT/JP2007/063782

§ 371 (c)(1),
(2), (4) Date: Jan. 21, 2009

(87) PCT Pub. No.: WO2008/007682

PCT Pub. Date: Jan. 17, 2008

(65) Prior Publication Data

US 2009/0199533 A1 Aug. 13, 2009

(30) Foreign Application Priority Data

Jul. 12, 2006 (JP) ..... 2006-191265

(51) Int. Cl.
*D02G 3/02* (2006.01)

(52) U.S. Cl. ..... 57/244; 57/247

(58) Field of Classification Search ..... 57/243–247, 57/332

See application file for complete search history.

(56) References Cited

U.S. PATENT DOCUMENTS

| | | | | |
|---|---|---|---|---|
| 2002/0116802 | A1 | 8/2002 | Moerman et al. | |
| 2003/0052436 | A1 * | 3/2003 | Koyanagi et al. | 264/178 R |
| 2005/0084676 | A1 * | 4/2005 | Koyanagi et al. | 428/375 |
| 2005/0106388 | A1 * | 5/2005 | Konishi et al. | 428/364 |

FOREIGN PATENT DOCUMENTS

| | | | | |
|---|---|---|---|---|
| JP | 11-172536 | A | * | 6/1999 |
| JP | 3208362 | B2 | * | 7/2001 |
| JP | 2001-303378 | A | * | 10/2001 |
| JP | 2001-348740 | A | * | 12/2001 |
| JP | 2005-82908 | A | * | 3/2005 |
| JP | 2005-113279 | A | * | 4/2005 |
| JP | 2005-232627 | A | * | 9/2005 |

* cited by examiner

*Primary Examiner* — Shaun R Hurley
(74) *Attorney, Agent, or Firm* — DLA Piper LLP (US)

(57) ABSTRACT

A false twisting yarn composed of monofilaments containing a polyester component of which main component is polytrimethylene terephthalate, wherein the false twisting yarn is a false twisting yarn which satisfies all of the requirements of (1) a shrinkage ratio by wet heat treatment at 98° C. for 20 minutes is 5% or less, (2) a ratio (TS/WS) of elastic stretch ratio after wet heat treatment at 90° C. for 20 minutes (WS) and elastic stretch ratio after dry heat treatment at 90° C. for 15 minutes (TS) is, $0<TS/WS\leqq 1$, and (3) a tensile strength is 2.0 cN/dtex or more. By using the false twisting yarn, it is possible to produce a pile cloth having a soft touch and a low shrinkage.

8 Claims, 3 Drawing Sheets

FALSE TWISTING YARN AND PRODUCTION METHOD THEREOF

RELATED APPLICATIONS

This is a §371 of International Application No. PCT/JP2007/063782, with an international filing date of Jul. 11, 2007 (WO 2008/007682 A1, published Jan. 17, 2008), which is based on Japanese Patent Application No. 2006-191265, filed Jul. 12, 2006.

TECHNICAL FIELD

This disclosure relates to a false twisting yarn composed of monofilaments containing a polyester component of which a main repeating unit is polytrimethylene terephthalate, and to a production method thereof.

BACKGROUND

Nowadays, polyester fiber is often applied not only to clothing, but also to general sheet materials for interiors because of the advantage that it is excellent in functionality, easiness of handling and fashionability. It is doubtless that such era in which polyester fiber is popular will continue more and its technical improvement and development will continue.

However, in recent years, in view of the global environmental conservation, enhancement of approaches to recycling and getting rid of petroleum-based synthetic fiber are strongly desired, and in the car industry which is a center of industry, there have been movements to take initiatives to solve this problem. In the fiber industry, too, it becomes essential to prepare for materials capable of converting to natural cultivation-reduction type.

In view of the above-mentioned background and looking toward the future, polylactic acid fiber or polytrimethylene terephthalate fiber is proposed and has been developed into practical use. Polytrimethylene terephthalate fiber has a low fiber Young's modulus and, in cases where it is used as a fabric such as a pile cloth, it forms a material having a very soft texture. In addition, it is understood to be a material excellent in light resistance and wear resistance.

As a fiber to be used for such a pile cloth, for example, 2 heater false twisting yarns of polytrimethylene terephthalate are proposed (i.e., refer to JP 2001-348740 A and Publication of JP Patent No. 3208362). However, in the 2 heater false twisting yarn of polytrimethylene terephthalate, crimp development by dry heat is large and results in a material having insufficient softness, and especially, a fabric with long piles having a high quality feeling cannot be obtained. In addition, its strength is insufficient and, for industrial material uses such as in cars where standards are high, it is a material which cannot satisfy such fabric standards.

As a material in which defects of polytrimethylene terephthalate material such as of the above-mentioned are improved and having handling properties of conventional polyester, a material in which polytrimethylene terephthalate and polyethylene terephthalate are composited into a core sheath configuration is proposed (i.e., refer to JP 2005-113279 A). However, since the softness of the material is lost in a later stage of processing, a further preferable false twisting yarn has been desired.

It could therefore be helpful to provide a false twisting yarn having a high strength and a soft texture when processed into a pile cloth, and capable of obtaining a pile cloth excellent in later stage processability.

SUMMARY

We found that a false twisting yarn of polytrimethylene terephthalate-based fiber capable of producing a fabric having a soft texture and a low shrinkage of which soft texture is not lost by heat history in later stage processes can be produced by false twisting a polytrimethylene terephthalate-based fiber yarn by using a 2 step heater false twisting method under specified conditions.

We thus provide:

[1] A false twisting yarn composed of monofilaments containing a polyester component of which main component is polytrimethylene terephthalate, wherein the false twisting yarn is a false twisting yarn which satisfies all of the following characteristics (1) to (3):

(1) a shrinkage ratio by wet heat treatment at 98° C. for 20 minutes is 5% or less;

(2) a ratio (TS/WS) of elastic stretch ratio after wet heat treatment at 90° C. for 20 minutes (WS) and elastic stretch ratio after dry heat treatment at 90° C. for 15 minutes (TS) is, $0<TS/WS\leqq 1$; and (3) a tensile strength is 2.0 cN/dtex or more.

[2] A false twisting yarn of the above-mentioned [1], wherein the monofilament is a composite fiber which contains a polyester component (A) of which main component is polytrimethylene terephthalate and other polyester component (B), and these components (A) and (B) are composited in a core sheath configuration along the fiber length direction.

[3] A false twisting yarn described in the above-mentioned [2], wherein the polyester component (B) is a polyester of which main component is polyethylene terephthalate.

[4] A false twisting yarn described in the above-mentioned [2] or [3], wherein the polyester component (A) of which main component is polytrimethylene terephthalate is disposed in the sheath side, and a ratio of the component (A) in the monofilament is 30 to 90 wt %.

[5] A false twisting yarn described in any one of the above-mentioned [1] to [4], wherein a number of crimp is 1 to 20 crimps/cm.

[6] A false twisting yarn described in any one of the above-mentioned [1] to [5], wherein all of the following (1'), (2), (3') and (4) are satisfied:

(1') a shrinkage ratio by wet heat treatment at 130° C. for 20 minutes is 5% or less;

(2) a ratio (TS/WS) of elastic stretch ratio after wet heat treatment at 90° C. for 20 minutes (WS) and elastic stretch ratio after dry heat treatment at 90° C. for 15 minutes (TS) is, $0<TS/WS\leqq 1$;

(3') a tensile strength is 2.5 cN/dtex or more; and (4) an elastic stretch ratio after dry heat treatment at 90° C. for 15 minutes is 0% or more and 5% or less.

[7] A production method of a false twisting yarn in which a false twisting is carried out by using a 2 heater false twisting method to a fiber composed of monofilaments containing a polyester component of which main component is polytrimethylene terephthalate, which is a production method of the false twisting yarn in which the false twisting is carried out at a yarn temperature at exit of twist region heater of 120° C. or more and 200° C. or less, at a yarn temperature at exit of 2nd set heater of 120° C. or more and 200° C. or less, at a false twisting coefficient (K) of 10,000 or more and 25,000 or less, and at a feeding ratio (%) in the 2nd set heater of 5% or more and 30% or less.

[8] A pile cloth containing a false twisting yarn described in any one of the above-mentioned [1] to [6].

[9] A composite intermingling yarn containing a false twisting yarn described in any one of the above-mentioned [1] to [6].

It is possible to produce a pile cloth having a soft texture and a low shrinkage by using the false twisting yarn. The obtained pile cloth does not lose soft texture of the material by heat history in later stage processes.

EXPLANATION OF REFERENCES

Figure 1:
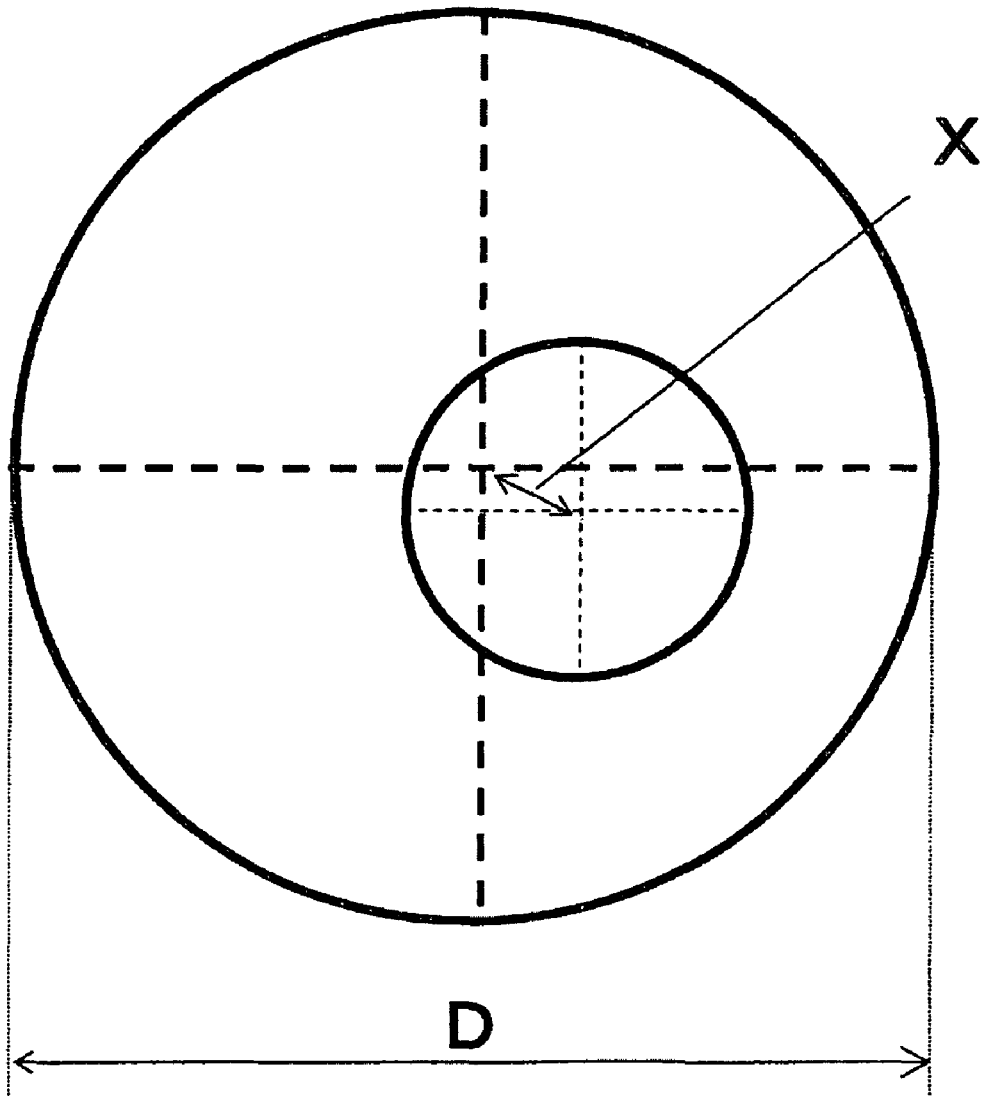
FIG. 1: A view showing an example of difference X between center positions of the 2 components.

X: Difference of center positions of the 2 components
C: Diameter of fiber cross section
L: Width of crimp
T: Height of crimp

DETAILED DESCRIPTION

In a case where polytrimethylene terephthalate fiber is used alone, as to strength, heat shrinkage, crimp fixation, wear durability, light resistance, etc., it exhibits considerably inferior characteristics and is not at a level comparative to conventional polyester fiber. In particular, in a case where it is used for a napped pile cloth, its inferiority is a problem. To improve the quality, there are many proposals to make polytrimethylene terephthalate into side-by-side type composite fibers with other polyester-based components, and considerable technical improvements have been made. However, such a side-by-side type composite fiber forms a high crimp by differences in shrink characteristics, and it is not suitable for a pile cloth which requires pile napping properties.

We investigated improving the above-mentioned polytrimethylene terephthalate fiber and, as a result, found a false twisting yarn of which characteristics are similar to conventional polyester fiber, and is excellent in handling property.

In the false twisting yarn, to obtain a pile cloth having a soft texture, it is important to satisfy a shrinkage ratio by wet heat treatment at 98° C. for 20 minutes (hereafter, referred to as 98° C. wet heat shrinkage ratio) of 5% or less. The 98° C. wet heat shrinkage ratio is preferably 3% or less and it may also be 0%. In a case where the 98° C. wet heat shrinkage ratio exceeds 5%, the cloth structure is densified at the dyeing process to produce a cloth of which the texture is stiff. At a yarn dyeing process, it causes defects in the process such as uneven dyeing. Furthermore, when the dyeing temperature is considered, a false twisting yarn of which shrinkage ratio by wet heat treatment at 130° C. for 20 minutes (hereafter, referred to as 130° C. wet heat shrinkage ratio) is 5% or less is more preferably used. The 130° C. wet heat shrinkage ratio is preferably 3% or less and it may also be 0%. Determination methods of the 98° C. wet heat shrinkage ratio and the 130° C. wet heat shrinkage ratio are in accordance with the methods described in the examples.

Furthermore, in the false twisting yarn, it is important that a ratio (TS/WS) of elastic stretch ratio after wet heat treatment at 90° C. for 20 minutes (WS) and elastic stretch ratio after dry heat treatment at 90° C. for 15 minutes (TS) is, $0<TS/WS\leqq 1$. In a case where $TS/WS>1$, at a dry heat treatment after dyeing, a fiber crimp is developed, and especially in the case where it is used as a pile cloth, the pile length becomes short due to the crimp and results in a cloth with a stiff texture. As a still more preferable range, a false twisting yarn of $0.2\leqq TS/WS\leqq 0.8$ is used. Methods of determining of the elastic stretch ratio after wet heat treatment at 90° C. for 20 minutes (WS) and the elastic stretch ratio after dry heat treatment at 90° C. for 15 minutes (TS) are in accordance with the methods described in the examples.

It is important that the tensile strength of the false twisting yarn is 2.0 cN/dtex or more. In a case where the tensile strength is lower than 2.0 cN/dtex or less, problems such as defects of later stage processability or a shortage of cloth strength arises. It is preferable that the tensile strength of the false twisting yarn is 2.5 cN/dtex or more, since it becomes a false twisting yarn capable of being used as a material for a vehicle interior or the like which has a strict cloth standard. It is preferable that the tensile strength of the false twisting yarn is higher, and although not especially limited, when the raw fiber strength at the present time is considered, about 4.0 cN/dtex is made as the upper limit of the false twisting yarn strength. Methods of determining of the tensile strength is based on the method described in the examples.

Furthermore, in the false twisting yarn, it is preferable that crimp development is small at steps after pile formation, especially at the step of dry heat treatment. Therefore, a false twisting yarn of which the elastic stretch ratio after dry heat treatment at 90° C. for 15 minutes (TS) is 20% or less is preferable, more preferably 10% or less, and still more preferably 5% or less. In a case where the elastic stretch ratio (TS) is more than 20%, at the dry heat treatment, crimp of the false twisting yarn develops, and the texture of pile cloth may become rather stiff. Depending on the design of the cloth or the like, it is possible to use a false twisting yarn having an elastic stretch ratio (TS) of about 20%, but it is possible to obtain a pile cloth more excellent in texture or quality by using a false twisting yarn having an elastic stretch ratio (TS) of 10% or less, still further, of 5% or less. On the other hand, since it is preferable in a high quality pile cloth that a fine crimp is present, it is preferable that the elastic stretch ratio (TS) is larger than 0%.

Furthermore, a false twisting yarn having a number of crimps of a monofilament of 1 to 20 crimps/cm is preferably used. In a false twisting yarn having a number of crimps exceeding 20 crimps/cm or more, the texture may become inferior in pile the cloth.

In the false twisting yarn, it is preferable that the monofilament contains a polyester component (A) of which the main component is polytrimethylene terephthalate and the other polyester component (B), and is a composite fiber (C) in which components (A) and (B) are composited in a core sheath configuration along the fiber length direction.

Furthermore, in the composite fiber (C), it is preferable that the polytrimethylene terephthalate component (A) and the other polyester component (B) are adhered substantially concentrically in a core sheath configuration. To be substantially concentrically in a core sheath configuration means that distance of center positions of the above-mentioned 2 components is small, and although not especially limited, the following range is applied as an index:

$$(\text{Difference of center positions of 2 components: } X)/(\text{diameter of cross section of composite fiber } (C): D)\times 100<10\%.$$

Figure 2:
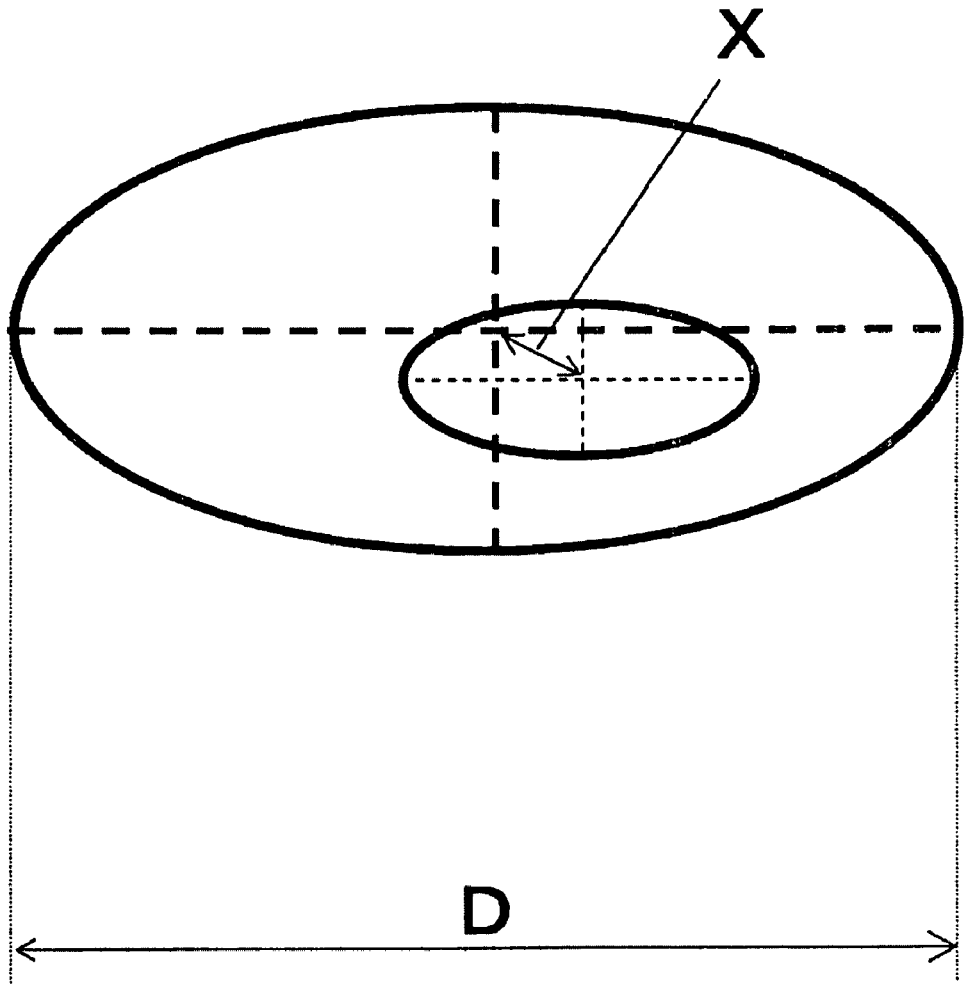
FIG. 2: A view showing an example of difference X between center positions of the 2 components.

The difference of center positions of the 2 components X is, as shown in FIGS. 1 and 2, distance between centers of the 2 components in cross section of the composite fiber (C). In a case where the cross section of the composite fiber (C) cross section is flat or irregular, the longest portion of the diameter of cross section (D) is taken as the diameter of cross section of the composite fiber (C). By being this distance of center positions of the 2 components small, the composite fiber (C) does not have a latent crimp, and the crimp configuration after false twisting becomes stable.

In the composite fiber (C), by compositing the polytrimethylene terephthalate component (A) and the other polyester component (B), its strength is greatly improved, and it becomes possible to obtain a cloth having a soft texture. Handling properties in later stage processes and cloth quality are also improved to make it possible to obtain effects of the same level as that of the conventional polyester. It is also attractive that approximately the same processes as those of the conventional polyester fiber can be applied.

The polytrimethylene terephthalate component (A) is a polyester obtainable from terephthalic acid as the main acid component and 1,3-propane diol as the main glycol component. Preferably, it is a polyester in which 80 mol % or more of the repeating unit is trimethylene terephthalate unit. However, in a ratio of 20 mol % or less, more preferably in a ratio of 10 mol % or less, it may contain a copolymerization component capable of forming an ester bond. As the copolymerization component, for example, dicarboxylic acids such as isophthalic acid, succinic acid, cyclohexane dicarboxylic acid, adipic acid, dimer acid, sebacic acid, 5-sodium sulfoisophthalate, diols such as ethylene glycol, diethylene glycol, butane diol, neopentyl glycol, cyclohexane dimethanol, polyethylene glycol, polypropylene glycol can be mentioned, but not limited thereto. As required, titanium dioxide as a delustering agent, fine particles of silica or alumina as a lubricant, a hindered phenol derivative as an antioxidant, a color pigment, etc., may be added. As to the 1,3-propane diol, a 1,3-propane diol prepared by a plant-based production method is preferably used.

In addition, as the other polyester component (B), polyethylene terephthalate, polybutylene terephthalate or the like can preferably be used. In consideration of compatibility with the polytrimethylene terephthalate component (A), strength and handling property in later stage processes, polyethylene terephthalate component is most preferably used.

As the polyethylene terephthalate, a polyester obtainable from terephthalic acid as the main acid component and ethylene glycol as the main glycol component is preferable. Preferably, it is a polyethylene terephthalate in which 80 mol % or more of the repeating unit is ethylene terephthalate unit. However, in a ratio of 20 mol % or less, a copolymerization component capable of forming an ester bond may be contained. The copolymerization component is, prefer-ably in a ratio of 0 to 15 mol %, more preferably in a ratio of 10 mol % or less. As the copolymerization component, for example, sulfonic acid, sodium sulfonate, sulfuric acid, sulfuric acid ester, diethyl sulfate, ethyl sulfate, aliphatic sulfonic acid, ethane sulfonic acid, chlorobenzene sulfonic acid, alicyclic sulfonic acid, dicarboxylic acids such as isophthalic acid, sebacic acid, azelaic acid, dimer acid, adipic acid, oxalic acid or decane dicarboxylic acid, dicarboxylic acids such as hydroxy carboxylic acids including p-hydroxy benzoic acid and c-caprolactone, diols such as triethylene glycol, polyethylene glycol, propane diol, butane diol, pentane diol, hydroquinone or bisphenol A, are preferably used. As required, titanium dioxide which is a delustering agent, fine particles of silica or alumina as a lubricant, a hindered phenol derivative as an antioxidant, a color pigment, etc., may be added.

As the fiber configuration of the composite fiber (C), it is preferable to make it into a core sheath type structure in which the polytrimethylene terephthalate component (A) is disposed in the sheath side which is the outer surface of the fiber, and the other polyester component (B) is disposed in the core side, but not limited thereto, and the core component and the sheath component may be reversed. By making it into the core sheath type structure, a soft texture and a silky coloring which are characteristic to the polytrimethylene terephthalate component (A) are exhibited, and inferiorities such as light resistance, pile napping properties, wear durability and pile falling down resistance are covered by the polyester component (B), and a high quality napped pile cloth can be obtained.

In a case where the polytrimethylene terephthalate component (A) is disposed in the sheath and the polyester component (B) is disposed in the core, it is preferable that the polytrimethylene terephthalate component (A) in a ratio of 30 to 90 wt % and the polyester component (B) in a ratio of 10 to 70 wt % are contained in the composite fiber (C). In a case where the polytrimethylene terephthalate component (A) is disposed in the sheath and the polyester component (B) is disposed in the core, the ratio of the polytrimethylene terephthalate component (A) in the composite fiber (C) is preferably 30 to 90 wt % and still more preferably 50 to 80 wt %. In this case, the ratio of the polyester component (B) in the composite fiber (C) is preferably 10 to 70 wt %, and 20 to 50 wt % is more preferable.

As the fiber cross sectional shape of the composite fiber (C), although not especially limited, those of which sheath component at fiber outer surface/core component are both perfectly circular or those of which the sheath component/core components are both elliptical in shape are preferably used in view of spinnability or strength. In particular, those of which sheath component/core component are both elliptical in shape are preferable since it is still softer and its pile cloth surface has a full volume feeling and it is possible to obtain an interior pile cloth excellent in a suede-like sense.

As to monofilament fiber thickness of the composite fiber (C), it is preferable to make it into a multifilament yarn of 5 dtex (decitex) or less, since it is possible to obtain an excellent pile cloth which exhibits a suede sense/feel by synergizing a fluffy feeling and a soft texture. In view of commercial product development, in a case where the monofilament fiber thickness is made into a still lower fiber thickness, it is preferable to be in the range of 0.5 to 2.0 dtex.

It is preferable that the false twisting yarn further satisfies all of the following characteristics (1'), (2), (3') and (4):

(1') 130° C. wet heat shrinkage ratio is 5% or less;

(2) A ratio (TS/WS) of elastic stretch ratio after wet heat treatment at 90° C. for 20 minutes (WS) and elastic stretch ratio after dry heat treatment at 90° C. for 15 minutes (TS) is, $0<TS/WS\leqq 1$;

(3') A tensile strength is 2.5 cN/dtex or more; and (4) An elastic stretch ratio after dry heat treatment at 90° C. for 15 minutes is 0% or more and 5% or less.

An example of a procedure for obtaining a pile cloth by using the false twisting yarn is explained. First, the false twisting yarn is dyed in a yarn dyeing process while developing crimp. Next, the false twisting yarn is formed into a pile cloth and heat set by a dry heat treatment process. When the wet heat shrinkage ratio of the false twisting yarn is large as stated above, since not only the soft texture is impaired, but also it causes defects of process such as an uneven dyeing at the yarn dyeing process, a false twisting yarn of which 130° C. wet heat shrinkage ratio is 5% or less is preferable. Since it is not preferable that the crimp developed at the yarn dyeing is highly developed at a dry heat treatment in later processes, it is necessary to satisfy the inequality of $0<TS/WS\leqq 1$. A false twisting yarn of which elastic stretch ratio after dry heat treatment at 90° C. for 15 minutes is 0% or more and 5% or less is more preferable. By using a false twisting yarn of which tensile strength is 2.5 cN/dtex or more, it is also possible to use for a vehicle interior material which has a strict cloth standard. That is, by using a false twisting yarn which satisfies all of the above-mentioned characteristics, it is possible to obtain a high quality pile cloth suitable for a vehicle interior material or the like.

Figure 3:
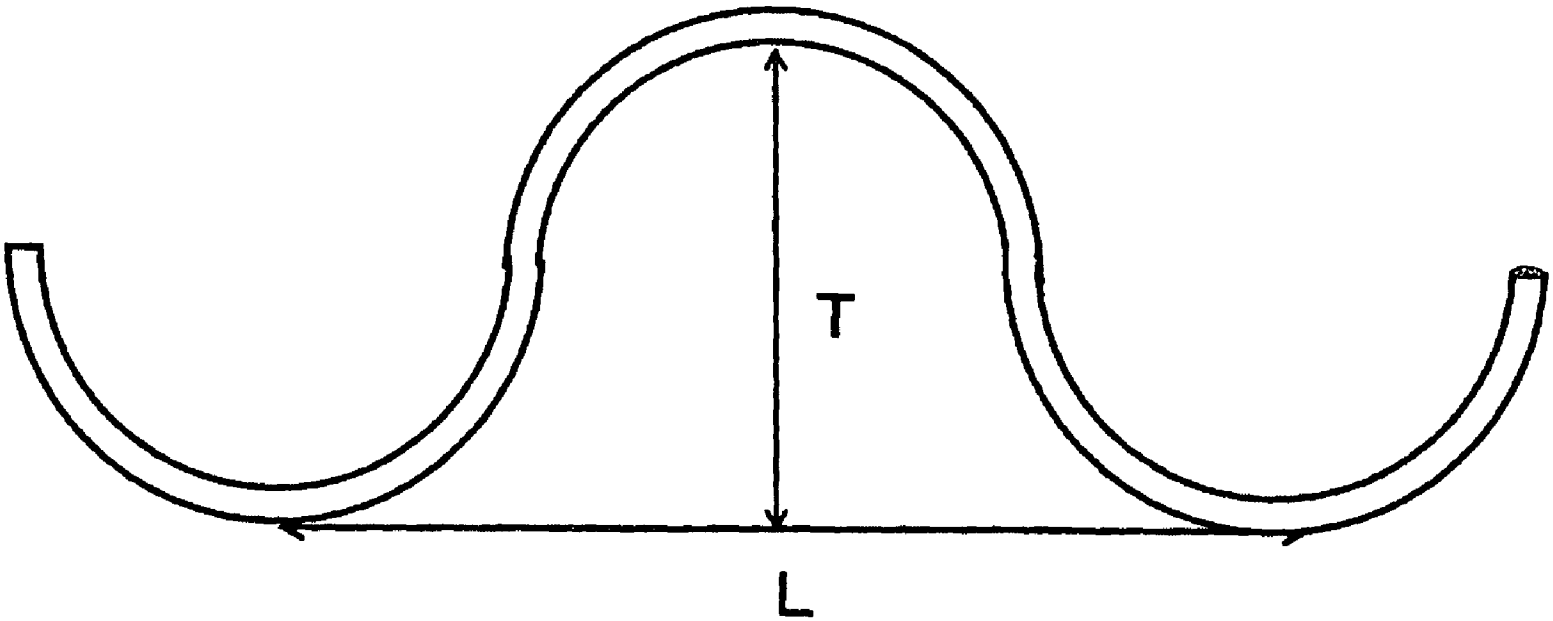
FIG. 3: A view showing a height of crimp T and a width of crimp L of a monofilament of false twisting yarn.

As an index for expressing a moderate crimp of the false twisting yarn, degree of crimp in configuration (KS) is suitably used. The degree of crimp in configuration (KS) is a monofilament crimp of false twisting yarn observed by an optical microscope as shown in FIG. 3, after the false twisting yarn is treated under no load at 98° C. in wet heat for 30 minutes and after dried, and expressed by the following equation:

$$\text{(Degree of crimp in configuration: } KS\text{)=(height of crimp: } T\text{)/(width of crimp; } L\text{)}\times 100(\%).$$

The width of crimp (L) is the distance of inflection points (valley), and the height of crimp (T) is the height from the common tangent between these inflection points (valley) to the inflection point (peak). The degree of crimp in configuration (KS) exhibits a bending configuration of crimp based on an observation of crimp, and in the case where the degree of crimp in configuration (KS) is 0%, the texture of pile cloth or quality of surface feeling decreases, and in the case where yarn dyeing is carried out, circulation of liquid flow becomes non-uniform to cause an uneven dyeing. On the other hand, in a case where the degree of crimp in configuration (KS) exceeds 30%, crimp development is large and the texture of the pile cloth becomes stiff. Accordingly, an appropriate range is, 0%<degree of crimp in configuration (KS)≦30%.

Next, a method for producing the false twisting yarn is explained. It is important to employ a 2 heater false twisting method. The 2 heater false twisting method is a method in which, after a false twisting of fiber is carried out in a twist region heater (1st step heater), the obtained false twisting yarn is successively heat set by a 2nd set heater (2nd step heater). To impart necessary characteristics as a false twisting yarn to the false twisting yarn to be obtained, temperature of the twist region heater, temperature of the 2nd set heater, false twist coefficient, and feeding ratio in the 2nd set heater are important. That is, the yarn temperature at the exit of the twist region heater is set at 120° C. or more and 200° C. or less, the yarn temperature at the exit of the 2nd set heater is set at 120° C. or more and 200° C. or less, the false twisting coefficient (K) is set at 10,000 or more and 25,000 or less, and the feeding ratio (%) in the 2nd set heater is set at 5% or more and 30% or less.

It is important that the yarn temperature at the exit of the twist region heater (here-after, referred to as twist region heater temperature) is 120° C. or more and 200° C. or less, and preferably, it is 140° C. or more and 180° C. or less. In a case where the twist region heater temperature is lower than 120° C., heat set ability to the imparted crimp is lost, and in the case where it is higher than 200° C., strength of the false twisting yarn decreases to decrease productivity, and thus, they are not preferable. As to the yarn temperature at the exit of the heater, it is measured for the yarn just after the exit of the heater by using a non-contact thermometer produced by Muratec, Ltd.

In addition, it is also important that the yarn temperature at the exit of the 2nd set heater (hereafter, referred to as 2nd set heater temperature) is 120° C. or more and 200° C. or less, and it is preferably 130° C. or more and 180° C. or less. By heat setting the false twisting yarn at the 2nd set heater, it is possible to decrease the wet heat shrinkage ratio, and possible to remove excessive crimp of the false twisting yarn. In a case where the 2nd set heater temperature is lower than 120° C., it is impossible to obtain a false twisting yarn of a low wet heat shrinkage ratio, and, in a case where it is higher than 200° C., it is not preferable since the strength of false twisting yarn decreases to decrease productivity.

In particular, in a case where the constituting fiber of the false twisting yarn is the core sheath type composite fiber (C) containing the above-mentioned polytrimethylene terephthalate component (A) and the polyethylene terephthalate component (B), and subjected to a false twisting in the above-mentioned temperature, in the composite fiber (C), it results in a condition in which the crimp of the polytrimethylene terephthalate component (A) is set and the crimp of the polyethylene terephthalate component (B) is not sufficiently set. Therefore, compared to a false twisting yarn in which the polytrimethylene terephthalate component is 100%, crimp is not developed largely by a dry heat treatment after a wet heat treatment. Accordingly, preferable characteristics as the false twisting yarn can easily be obtained.

Furthermore, it is important that the false twisting coefficient (K) is 10,000 or more and 25,000 or less, and more preferably 12,000 or more and 20,000 or less. By carrying out a false twisting in such range of the false twisting coefficient, it is possible that the obtained false twisting yarn can exhibit a moderate crimp. False twisting coefficient (K) is expressed by (actual number of false twisting: T/m)×(fiber thickness: denier)$^{1/2}$.

Furthermore, by setting the feeding ratio in the 2nd set heater to a high feeding ratio of 5% or more and 30% or less, the false twisting yarn is heat set in a crimped condition. By this way, the shrinkage ratio of the false twisting yarn can be made low, and a low percentage of crimp and a moderate crimp configuration are obtained. In a case where the feeding ratio in the 2nd set heater is less than 5%, it becomes impossible to decrease the shrinkage ratio of the false twisting yarn, and in a case where it exceeds 30%, it is not preferable since slacking occurs in the 2nd set heater, to cause a decrease of productivity.

As a method of the false twisting, any generally employed method can be employed such as a pin type, a friction disk type, a nip belt type or an air twisting type.

Furthermore, by making a composite intermingling yarn in which the false twisting yarn is used as the core yarn or sheath yarn, in addition to textures such as volume feeling or softness, it is possible to obtain a pile cloth having a peculiar surface feeling. It is preferable to use the false twisting yarn as a sheath yarn of the composite intermingling yarn, and a material having a high shrinkage ratio as a core yarn, since a pile cloth especially with a volume feeling and having a peculiar surface feeling is made. The material having a high shrinkage ratio is, not especially limited, but a copolymerization polyester copolymerized with isophthalic acid, bisphenol or the like are mentioned. Although not especially limited, as to the shrinkage ratio of the core yarn, it is preferable that the boiling water shrinkage ratio is 15% or more, and 20% or more is more preferable. When strength or dyeability is considered, a core yarn of the polyester-based component is preferably used.

As a method for intermingling the false twisting yarns, it may be any generally employable method such as an interlace intermingling, a fluid disturbance ("Taslan"® intermingling.

EXAMPLE

Hereafter, our yarns and methods are explained with reference to examples. However, yarns and methods are not limited at all by the examples. Whereas, evaluations are based on the following determination methods.

(1) Intrinsic Viscosity (IV)

0.8 g of a sample polymer is dissolved in 10 ml o-chlorophenol (hereafter, abbreviated as OCP), and its relative viscosity at 25° C. [$\eta_r$] is measured by an Oswald viscometer. It is a value (IV) calculated from the relative viscosity according to the following equation:

$$\text{Relative viscosity } [\eta_r]=\eta/\eta_0=(t\times q)/(t_0\times q_0)$$

$$\text{Intrinsic viscosity } [IV]=0.0242\eta_r+0.2634.$$

Whereas, $\eta$: Viscosity of polymer solution, $\eta_0$: Viscosity of OCP, t: Fall time of solution (sec), q: Density of solution (g/cm$^3$), $t_0$: Fall time OCP (sec), $q_0$: Density of OCP (g/cm$^3$).

(2) Elastic Stretch Ratio after 90° C. Dry Heat Treatment (TS)

A sample was treated under a load of 2.6×10−4 cN/dtex and under a dry heat of 90° C. for 15 minutes. After that, the load was removed and after the sample was slackened at room temperature for 24 hours to stabilize its crimp, the elastic stretch ratio was measured in accordance with JIS-L-1013•Test Method of Stretch Properties (1999 edition), and an average of 10 times was calculated.

(3) Elastic Stretch Ratio after 90° C. Wet Heat Treatment (WS)

A sample was treated under a load of 2.6×10−4 cN/dtex and under a wet heat of 90° C. for 20 minutes. After that, the load was removed and after the sample was slackened at room temperature for 24 hours to stabilize its crimp, the elastic stretch ratio was measured in accordance with JIS-L-1013•Test Method of Stretch Properties (1999 edition), and an average of 10 times was calculated.

(4) 98° C. Wet Heat and 130° C. Wet Heat Shrinkage Ratios

After a sample was treated under a wet heat condition of 98° C. or 130° C. for 20 minutes, wet heat shrinkage ratio was measured in accordance with JIS-L-1013•Test Method of Hot Water Shrinkage Ratio (1999 edition), and an average of 10 times was calculated.

(5) Number of Crimp

After a sample was treated under a load of 2.6×10−4 cN/dtex and under a dry heat of 90° C. for 15 minutes, the load was removed and after the sample was slackened at room temperature for 24 hours to stabilize its crimp. After that, in a condition under a load of 1.8×10$^{-3}$ cN/dtex, numbers of peak and valley of crimp for a sample length of 1 cm of monofilament was measured, the respective values were totaled and multiplied by ½, and the product was taken as the number of crimp. An average of 10 times were calculated, and expressed in crimps/cm.

(6) Tensile Strength and Elongation

A tensile strength and elongation of a sample was measured in accordance with JIS-L-1013 method, Tensile Test Method of Synthetic Fiber Filament (1999 edition).

(7) Surface Quality

A sensory judgment of covering properties and napped fiber feeling of a pile cloth surface was carried out at 4 levels evaluation of "quality fiber napping property is excellent to bad" (A; excellent quality, B; good, C; rather bad, D; bad) by visual observation, and is expressed by an average result of 5 skilled persons.

(8) Softness

As to surface touch of pile cloth, a sensory judgment was carried out at 4 levels evaluation of "softness is excellent to coarse" (A; softness excellent, B; softness good, C; smooth and silky feeling is strong, D; coarse), and is expressed by an average result of 5 skilled persons.

(9) Surface Feeling

As to sense of surface glossiness of the pile cloth, a sensory judgment was carried out at 4 levels evaluation of "excellent silky glossiness to unpleasant glossiness" (A; excellent silky glossiness, B; the same is good, C; semi-dull polyester tone, D; bright polyester tone), and is expressed by an average result of 5 skilled persons.

(10) Later Stage Passability in Cloth Production

"Later stage passability" at pile cloth production is judged at 4 levels evaluation (A; no yarn breakage, B; some yarn breakages but no problem in cloth, C; some yarn breakages and some problems in cloth quality, D; unable to knit due to yarn breakages).

Examples 1 and 2

A core sheath composite fiber consisting of 70 wt % of polytrimethylene terephthalate homopolymer having an intrinsic viscosity (IV) of 1.40 as sheath component and 30 wt % polyethylene terephthalate homopolymer having an intrinsic viscosity (IV) of 0.60 as core component was spun. The core component and the sheath component were separately melted at a spinning temperature of 280° C., respectively, extruded from a composite spinning spinneret of sheath/core concentric type having 60 holes, and taken up at a spinning speed of 3300 m/min. A round type cross sectional highly oriented undrawn yarn of 1 dtex (decitex)-60fil (filament) was obtained.

The obtained undrawn yarn was drawn, by using a drawing machine equipped with a set of hot roll-hot plate, at a hot roll temperature of 85° C., a hot plate temperature of 145° C. and a draw ratio of 1.40 times, to obtain a drawn yarn of 84dtex-60fil. Physical characteristics of the obtained drawn yarn were tensile strength 3.4 cN/dtex, elongation 41% and 98° C. boiling water wet heat shrinkage ratio 9.5%.

In Example 1, by using 2 drawn yarns obtained by the above-mentioned method and by using TH312 false twisting machine (the twist region heater is a contact type, the 2nd set heater is a non-contact type and the processing mechanism is a pin false twisting method) produced by Aiki Seisakusho, a 2 heater false twisting is carried out at a twist region heater temperature of 170° C., a 2nd set heater temperature of 150° C., a process speed of 130 m/min, a draw ratio of 1.03, a number of false twisting of 1800 T/m and at a feeding ratio of 20%, and a false twisting yarn of 180dtex-120fil was obtained. The yarn temperature at the exit of the twist region heater was 169° C. to 170° C., and the yarn temperature at the exit of the 2nd set heater was 148 to 150° C.

Furthermore, in Example 2, a false twisting yarn of 177dtex-120fil was obtained by carrying out 2 heater false twisting in the same way as Example 1 except setting a twist region heater temperature of 170° C., a 2nd set heater temperature of 160° C., a process speed of 130 m/min, a draw ratio of 1.03, a number of false twisting 2200 T/m and a feeding ratio of 14%. The yarn temperature at the exit of the twist region heater was 169° C. to 170° C., and the yarn temperature at the exit of the 2nd set heater was 158 to 160° C.

By using the obtained false twisting yarn as a pile yarn, and by using a polyester 84dtex-24fil yarn as a base yarn, a cut pile cloth having a pile length of 2.5 mm was knitted by a tricot machine of 22 gauge. Physical characteristics of the false twisting yarn and evaluation results of the pile cloth are shown in Table 1.

Example 3

A 2 step heater false twisting was carried out by using one yarn of the same drawn yarn as that of Examples 1 and 2 and, by using the same false twisting machine at a twist region heater temperature of 160° C., a 2nd set heater temperature of 150° C., a process speed of 130 in/min, a draw ratio of 1.03, a number of false twist of 1900 T/m and a feeding ratio in 2nd set heater of 12%, and a processed yarn of 87dtex-60fil was obtained. A pile cloth was obtained in the same way as Example 1. Physical characteristics of the obtained false twisting yarn and evaluation results of the pile cloth are shown in Table 1.

Example 4

Polytrimethylene terephthalate having an intrinsic viscosity (IV) of 1.40 was melted at 275° C., extruded from a spinneret having 60 holes, and taken up at a spinning speed of 3300 m/min to obtain a round cross-sectional type highly oriented undrawn yarn of 118 dtex (decitex)-60fil(filament).

Furthermore, by using a drawing machine equipped with a set of hot roll-hot plate, the yarn was drawn at a hot roll temperature of 85° C., hot plate temperature of 145° C. and a draw ratio of 1.40 times, and a drawn yarn of 84dtex-60fil was obtained. Physical characteristics of the drawn yarn were, tensile strength 3.3 cN/dtex, elongation 37% and boiling water shrinkage ratio 7.8%.

The drawn yarn obtained by the above-mentioned method was subjected to a 2 step heater false twisting by using the same false twisting machine as those of Examples 1 and 2, at a twist region heater temperature of 170° C., a 2nd set heater temperature of 150° C., a process speed of 130 m/min, a draw ratio of 1.01 and a number of false twist of 1900 T/m, and a false twisting yarn of 84dtex-60fil was obtained. The yarn temperature at the exit of the twist region heater was 168° C. to 170° C., and the yarn temperature at the exit of the 2nd set heater was 148 to 150° C. The feeding ratio in the 2nd set heater was made into the condition shown in Table 1. A pile cloth was prepared by using the obtained false twisting yarn in the same way as Example 1. Physical characteristics of the obtained false twisting yarn and evaluation results of the pile cloth are shown in Table 1.

Example 5

After the false twisting in Example 3, without winding, the false twisting yarn and a high shrinkage yarn consisting of a polyester containing sulfonic acid and isophthalic acid as copolymerization components (56dtex-24fil, tensile strength 4.0 cN/dtex, elongation 41.3% and boiling water shrinkage 9.9%) are intermingled by an air intermingling with an interlace nozzle, and a false twisted intermingling yarn of 156 dtex was obtained.

A pile cloth was prepared in the same way as Example 1. Physical characteristics of the obtained false twisting yarn and evaluation results of the pile cloth are shown in Table 1. The pile cloth was a cloth having a volume feeling of piles and a peculiar particulate sense in surface feeling.

Comparative Example 1

By using the same drawn yarn and the same false twisting machine as Examples 1 and 2, a one step heater false twisting was carried out in a condition at a twist region heater temperature of 160° C., a process speed of 130 m/min, a draw ratio of 1.03 and a number of false twist of 3200 T/m, and a processed yarn of 84dtex-60fil was obtained. The yarn temperature at the exit of the twist region heater was 158° C. to 160° C. A pile cloth was prepared in the same way as Example 1. Physical characteristics of the obtained false twisting yarn and evaluation results of the pile cloth are shown in Table 1.

Comparative Example 2

By using 2 yarns of the same drawn yarn as Example 4 and the same false twisting machine, a 2 heater false twisting was carried out at a twist region heater temperature of 170° C., a 2nd set heater temperature of 150° C., a process speed of 130 m/min, a draw ratio of 1.01, a number of false twist of 2300 T/m and a feeding ratio in the 2nd set heater of 20%, and a false twisting yarn of 178dtex-120fil was obtained. The yarn temperature at the exit of the twist region heater was 169° C. to 170° C., and the yarn temperature at the exit of the 2nd set heater was 148 to 150° C. A pile cloth was prepared in the same way as Example 1. Physical characteristics of the obtained false twisting yarn and evaluation results of the pile cloth are shown in Table 1. The pile cloth was rather stiff in texture, and a high grade one could not be obtained.

Comparative Example 3

By using 2 yarns of the same drawn yarn as Examples 1 and 2 and by using the same false twisting machine, a 2 heater false twisting was carried out at a twist region heater temperature of 170° C., a 2nd set heater temperature of 150° C., a process speed of 130 m/min, a draw ratio of 1.01, a number of false twist of 2400 T/m and a feeding ratio in the 2nd set heater of 20%, and a false twisting yarn of 180dtex-120fil was obtained. The yarn temperature at the exit of the twist region heater was 169° C. to 170° C., and the yarn temperature at the exit of the 2nd set heater was 148 to 150° C. A pile cloth was prepared in the same way as Example 1. Physical characteristics of the obtained false twisting yarn and evaluation results of the pile cloth are shown in Table 1. The pile cloth was rather stiff in texture, and a high grade one could not be obtained.

Comparative Example 4

By using 2 yarns of the same drawn yarn as Examples 1 and 2 and by using the same false twisting machine, a 2 heater false twisting was carried out at a twist region heater temperature of 170° C., a 2nd set heater temperature of 150° C., a process speed of 130 m/min, a draw ratio of 1.01, a number of false twist of 2400 T/m and a feeding ratio in the 2nd set heater of 3%, and a false twisting yarn of 169 dtex-120fil was obtained. The yarn temperature at the exit of the twist region heater was 169° C. to 170° C., and the yarn temperature at the exit of the 2nd set heater was 148 to 150° C. A pile cloth was prepared in the same way as Example 1. Physical characteristics of the obtained false twisting yarn and evaluation results of the pile cloth are shown in Table 1. The pile cloth was stiff in texture, and a high grade one could not be obtained.

TABLE 1

| | | Ex. 1 | Ex. 2 | Ex. 3 | Ex. 4 | Ex. 5 |
|---|---|---|---|---|---|---|
| Drawn yarn | Sheath component | PTT | PTT | PTT | PTT | PTT |
| | Core component | PET | PET | PET | | PET |
| | Fiber thickness constitution (dtex-fil) | 84-60 | 84-60 | 84-60 | 84-60 | 84-60 |
| | Composite ratio (sheath/core) | 70/30 | 70/30 | 70/30 | — | 70/30 |
| False twisting conditions | Process speed (m/min) | 130 | 130 | 130 | 130 | 130 |
| | 1 HT/2 HT temperature (° C.) | 170/150 | 170/160 | 160/150 | 170/150 | 160/150 |
| | Number of twist (t/m) | 1800 | 2200 | 1900 | 1900 | 1900 |
| | False twisting coefficient (K) | 15700 | 19100 | 16500 | 16500 | 16500 |
| | 2 HT feeding ratio | 20 | 14 | 12 | 12 | 12 |
| Characteristics of false twisting yarn | Fiber thickness (dtex) | 180 | 177 | 87 | 90 | 89 |
| | Elastic stretch ratio TS (%) after 90° C. dry heat treatment | 12.3 | 4.8 | 3.2 | 4.6 | 3.2 |
| | Elastic stretch ratio WS (%) after 90° C. wet heat treatment | 21.0 | 11.1 | 6.0 | 4.9 | 6.0 |
| | TS/WS | 0.58 | 0.43 | 0.53 | 0.94 | 0.53 |
| | Number of crimp (crimps/cm) | 5.20 | 8.55 | 2.80 | 3.35 | 3.60 |
| | 98° C. wet heat shrinkage ratio (%) | 2.5 | 1.1 | 1.3 | 2.8 | 1.3 |
| | 130° C. wet heat shrinkage ratio (%) | 4.8 | 3.5 | 3.7 | 4.7 | 3.7 |
| | Strength (cN/dtex) | 3.02 | 3.05 | 2.98 | 2.56 | 2.98 |
| Processability | False twisting processability | A | A | A | B | A |
| | Later stage passability in cloth production | A | A | A | B | B |
| Texture | Softness | A | B | A | A | C |
| | Surface quality | A | A | B | B | A |
| | Surface feeling | A | B | A | A | B |

| | | Comp. ex. 1 | Comp. ex. 2 | Comp. ex. 3 | Comp. ex. 4 |
|---|---|---|---|---|---|
| Drawn yarn | Sheath component | PTT | PTT | PTT | PTT |
| | Core component | PET | | PET | PET |
| | Fiber thickness constitution (dtex-fil) | 84-60 | 84-60 | 84-60 | 84-60 |
| | Composite ratio (sheath/core) | 70/30 | — | 70/30 | 70/30 |
| False twisting conditions | Process speed (m/min) | 130 | 130 | 130 | 130 |
| | 1 HT/2 HT temperature (° C.) | 160/— | 170/150 | 180/130 | 180/130 |
| | Number of twist (t/m) | 3200 | 2400 | 2400 | 2400 |
| | False twisting coefficient (K) | 27800 | 20900 | 20900 | 20900 |
| | 2 HT feeding ratio | — | 20 | 20 | 3 |
| Characteristics of false twisting yarn | Fiber thickness (dtex) | 84 | 178 | 180 | 169 |
| | Elastic stretch ratio TS (%) after 90° C. dry heat treatment | 318.2 | 18.3 | 37.8 | 4.4 |
| | Elastic stretch ratio WS (%) after 90° C. wet heat treatment | 256.1 | 17.7 | 35.9 | 3.8 |
| | TS/WS | 1.24 | 1.03 | 1.05 | 1.16 |
| | Number of crimp (crimps/cm) | 98.00 | 12.60 | 14.80 | 3.80 |
| | 98° C. wet heat shrinkage ratio (%) | 11.5 | 2.4 | 3.9 | 10.6 |
| | 130° C. wet heat shrinkage ratio (%) | 18.1 | 4.8 | 6.6 | 14.3 |
| | Strength (cN/dtex) | 2.99 | 2.39 | 2.71 | 3.07 |
| Processability | False twisting processability | A | B | A | A |
| | Later stage passability in cloth production | A | C | A | D |
| Texture | Softness | D | B | C | D |
| | Surface quality | C | C | C | D |
| | Surface feeling | C | B | B | C |

PET: polyethylene terephthalate
PTT: polytrimethylene terephthalate

Examples 6 to 8 and Comparative Example 5

A core sheath composite fiber is spun in the same way as Example 1 except changing the ratio of polytrimethylene terephthalate homopolymer and polyethylene terephthalate homo-polymer to those shown in Table 2. A 2 step heater false twisting is carried out by using the obtained core sheath composite fiber in the same way as Example 1, and further, a pile cloth is prepared in the same way as Example 1. Physical characteristics of the obtained false twisting yarn and evaluation results of the pile cloth are understood to be those as shown in Table 2.

TABLE 2

| | | Ex. 6 | Ex. 7 | Ex. 8 | Comp. ex. 5 |
|---|---|---|---|---|---|
| Drawn yarn | Sheath component | PTT | PTT | PTT | PTT |
| | Core component | PET | PET | PET | PET |
| | Fiber thickness constitution (dtex-fil) | 84-60 | 84-60 | 84-60 | 84-60 |
| | Composite ratio (sheath/core) | 50/50 | 90/10 | 30/70 | 20/80 |

TABLE 2-continued

| | | Ex. 6 | Ex. 7 | Ex. 8 | Comp. ex. 5 |
|---|---|---|---|---|---|
| False twisting condition | Process speed (m/min) | 130 | 130 | 130 | 130 |
| | 1 HT/2 HT temperature (° C.) | 170/150 | 170/150 | 170/150 | 170/150 |
| | Number of false twist (T/m) | 1800 | 1800 | 1800 | 1800 |
| | False twisting coefficient (K) | 15700 | 15700 | 15700 | 15700 |
| | 2 HT feeding ratio | 20 | 20 | 20 | 20 |
| Characteristics of false twisting yarn | Fiber thickness (dtex) | 132 | 120 | 103 | 102 |
| | Elastic stretch ratio TS (%) after 90° C. dry heat treatment | 7.6 | 15.3 | 10.2 | 13.0 |
| | Elastic stretch ratio WS (%) after 90° C. wet heat treatment | 15.4 | 23.0 | 13.0 | 12.1 |
| | TS/WS | 0.49 | 0.67 | 0.78 | 1.07 |
| | Number of crimp (crimps/cm) | 4.63 | 5.20 | 1.80 | 0.53 |
| | 98° C. wet heat shrinkage ratio (%) | 2.3 | 2.9 | 1.9 | 13.0 |
| | 130° C. wet heat shrinkage ratio (%) | 4.5 | 6.3 | 4.1 | 12.5 |
| | Strength (cN/dtex) | 3.20 | 2.85 | 3.80 | 4.31 |
| Processability | False twisting processability | A | A | A | A |
| | Later stage passability in cloth production | A | A | A | A |
| Texture | Softness | A | A | B | D |
| | Surface quality | A | A | A | B |
| | surface feeling | A | A | B | C |

INDUSTRIAL APPLICABILITY

By using our false twisting yarns, a pile cloth having a soft texture and a low shrinkage can be prepared. In the obtained pile cloth, the soft texture possessed by the material is not lost by heat history at later stage processes.

The invention claimed is:

1. A false twisting yarn comprising monofilaments containing a polyester component of which a main component is polytrimethylene terephthalate, and satisfying characteristics (1) to (3):

(1) a shrinkage ratio by wet heat treatment at 98° C. for 20 minutes is 5% or less;

(2) a ratio (TS/WS) of elastic stretch ratio after wet heat treatment at 90° C. for 20 minutes (WS) and elastic stretch ratio after dry heat treatment at 90° C. for 15 minutes (TS) is, $0<TS/WS\leqq 1$; and (3) a tensile strength is 2.0 cN/dtex or more;

wherein the monofilament is a composite fiber which contains a polyester component (A) of which main component is polytrimethylene terephthalate and other polyester component (B), and these components (A) and (B) are composited in a substantially concentrically core sheath configuration along the fiber length direction.

2. The false twisting yarn according to claim 1, wherein said polyester component (B) is a polyester of which a main component is polyethylene terephthalate.

3. The false twisting yarn according to claim 1, wherein the polyester component (A) is disposed in the sheath, and a ratio of said component (A) in the monofilament is 30 to 90 wt %.

4. The false twisting yarn according to claim 1, wherein a number of crimp is 1 to 20 crimps/cm.

5. The false twisting yarn according to claim 1, wherein characteristics (4) to (6) are satisfied:

(4) a shrinkage ratio by wet heat treatment at 130° C. for 20 minutes is 5% or less;

(5) a tensile strength is 2.5 cN/dtex or more; and (6) an elastic stretch ratio after dry heat treatment at 90° C. for 15 minutes is 0% or more and 5% or less.

6. A method of producing a false twisting yarn in which false twisting is carried out with a 2 heater false twisting method to a fiber comprising monofilaments containing a polyester component of which a main component is polytrimethylene terephthalate, wherein said false twisting is carried out at a yarn temperature at an exit of a twist region heater of 120° C. or more and 200° C. or less, at a yarn temperature at an exit of a 2nd set heater of 120° C. or more and 200° C. or less, at a false twisting coefficient (K) of 10,000 or more and 25,000 or less, and at a feeding ratio (%) in the 2nd set heater of 5% or more and 30% or less.

7. A pile cloth comprising a false twisting yarn according to claim 1.

8. A composite intermingling yarn comprising a false twisting yarn according to claim 1.

* * * * *